US007334916B2

(12) United States Patent
Doll et al.

(10) Patent No.: US 7,334,916 B2
(45) Date of Patent: Feb. 26, 2008

(54) ILLUMINATION DEVICE

(75) Inventors: Gerhard Doll, Guangzhou (CN); Martin Zachau, Geltendorf (DE)

(73) Assignee: Patent-Treuhand-Gesellschaft fuer Elektrisćche Gluehlampen mbH, Munich (DE)

( * ) Notice: Subject to any disclaimer, the term of this patent is extended or adjusted under 35 U.S.C. 154(b) by 2 days.

(21) Appl. No.: 11/048,735

(22) Filed: Feb. 3, 2005

(65) Prior Publication Data

US 2005/0231944 A1 Oct. 20, 2005

(30) Foreign Application Priority Data

Feb. 10, 2004 (DE) ..... 10 2004 006 614

(51) Int. Cl.
*H01J 1/62* (2006.01)

(52) U.S. Cl. ..... 362/231; 362/228; 362/263; 362/84; 313/486; 313/468

(58) Field of Classification Search ..... 362/230, 362/231, 260, 225, 249, 225.84, 229, 263; 313/486, 467, 468, 634, 487, 495
See application file for complete search history.

(56) References Cited

U.S. PATENT DOCUMENTS

| | | | | |
|---|---|---|---|---|
| 5,138,223 | A | 8/1992 | Osada et al. | |
| 6,316,872 | B1 | 11/2001 | Ge et al. | |
| 6,509,685 | B1 * | 1/2003 | Justel et al. | 313/486 |
| 6,967,448 | B2 * | 11/2005 | Morgan et al. | 315/295 |
| 7,122,951 | B2 * | 10/2006 | Heider et al. | 313/487 |
| 2002/0030437 | A1 * | 3/2002 | Shimizu et al. | 313/495 |
| 2004/0100182 | A1 * | 5/2004 | Custodis et al. | 313/486 |
| 2006/0023447 | A1 * | 2/2006 | Justel et al. | 362/231 |
| 2006/0285325 | A1 * | 12/2006 | Ducharme et al. | 362/231 |

FOREIGN PATENT DOCUMENTS

| | | |
|---|---|---|
| DE | 100 56 745 A1 | 5/2002 |
| EP | 0 222 928 | 5/1987 |
| EP | 0 851 462 | 7/1998 |
| GB | 2167895 A | 6/1986 |
| JP | 07 272695 | 10/1995 |
| WO | WO 89/12780 | 12/1989 |

* cited by examiner

*Primary Examiner*—Thomas M. Sember
(74) *Attorney, Agent, or Firm*—Robert F. Clark

(57) ABSTRACT

An electrical illumination device for generating saturated colors with at least two illumination units. The illumination units each have a discharge vessel with a low-pressure discharge and a phosphor coating on the inner wall of the vessel, characterized in that at least one illumination unit has a discharge vessel with a xenon fill and a dielectric barrier discharge.

9 Claims, 8 Drawing Sheets

ILLUMINATION DEVICE

TECHNICAL FIELD

The invention is based on an electrical illumination device for generating saturated colors with at least two illumination units, the illumination units each having a discharge vessel with a low-pressure discharge and a phosphor coating on the inner wall of the vessel.

BACKGROUND ART

Hitherto, there have been no illumination devices which on the one hand in the undimmed state have far higher light yields than an incandescent or halogen incandescent lamp and on the other hand have a color temperature which changes when it is dimmed in a similar way to an incandescent lamp.

FIG. 1 shows the color locus of an incandescent lamp in the undimmed state (locus 1) and in the dimmed state (locus 2). When the incandescent lamp is dimmed, the color temperature is reduced at the same time as the intensity of illumination, the light becomes "warmer", and the fraction of the light emitted in the red spectral region grows. Therefore, the incandescent lamp has a similar behavior to daylight, which has a lower illumination intensity and a lower color temperature in the morning and evening than during the middle of the day. The human eye and sensitivity are attuned to this. By contrast, the fact that the color temperature of Hg fluorescent lamps remains constant or even rises when the lamps are dimmed is considered unpleasant.

A further problem is that with illumination devices which are fitted with incandescent or halogen incandescent lamps, the luminous color cannot be varied beyond a maximum possible range of the chromaticity diagram. Incandescent or halogen incandescent lamps are not suitable for this purpose, since their light yield is low and their color locus is more or less on the Planckian locus (FIG. 1). The remainder of the chromaticity diagram can only be achieved with the aid of color filters, which would reduce the light yield.

One solution under discussion is that of combining a plurality of Hg fluorescent lamps. With a fluorescent lamp with a mercury discharge, a blue (barium magnesium aluminate:Eu=Hg-BAM), a green (cerium magnesium aluminate:Tb=Hg-CAT) and a red (yttrium oxide:Eu=YOE) phosphor coating and a common electronic ballast which can vary the intensities of the three fluorescent lamps independently of one another, it is possible to set all the color loci in the chromaticity diagram encompassed by the three individual fluorescent lamps (Hg-BAM, Hg-CAT, Hg-YOE) (cf. FIG. 1). However, the drawback of this solution is that Hg fluorescent lamps cannot generate saturated red, green or yellow light, because the Hg low-pressure discharge, in addition to the UV radiation which excites the phosphor, also emits an excessively high level of blue light. Consequently, white light with color temperatures<2600 K, as are generated, for example, when an incandescent lamp is dimmed, cannot be generated.

Therefore, it is an object of the invention to provide an illumination device which avoids the drawbacks listed above.

DISCLOSURE OF THE INVENTION

In an electrical illumination device for generating saturated colors with at least two illumination units, the illumination units each having a discharge vessel with a low-pressure discharge and a phosphor coating on the inner wall of the vessel the object is achieved by virtue of the fact that at least one illumination unit has a discharge vessel with a xenon fill and a dielectric barrier discharge (Xe excimer discharge).

FIG. 1 shows the chromaticity diagrams which are encompassed by the combination of in each case one Hg fluorescent lamp with a red, green and blue (Hg-YOE, Hg-CAT, Hg-BAM) phosphor coating and an Xe excimer fluorescent lamp with a red (yttrium gadolinium borate: Eu=XeYOB), green (lanthanum phosphate:Ce, Tb=Xe-LAP) and blue (barium magnesium aluminate:Eu=Xe-BAM) phosphor coating. If the lamp combination includes red and green Xe-excimer fluorescent lamps, the chromaticity diagram widens into the green, yellow and red color region. Therefore, it is even possible to achieve saturated red and yellow luminous colors and therefore to set the color temperatures of a dimmed incandescent lamp.

As an alternative to the phosphors BAM, LAP and YOB, it is also possible to use other VUV-excitable phosphors, such as alternative Tb-doped green phosphors and Eu-doped red phosphors, in the Xe-excimer lamp, the emission radiation from which has a color locus in the vicinity of the spectrum locus. Suitable phosphors are listed, for example, in WO94/22975. In the case of the Xe-excimer lamps, the color locus of the lamp corresponds to that of the applied phosphor, since the dielectric barrier Xe discharge itself contributes scarcely any visible radiation component. By contrast, in the case of the Hg low-pressure discharge lamp the color locus of the lamp does not coincide with the color locus of the applied phosphor, since the Hg discharge has its own color locus in the visible (cf. Hgvis in FIG. 1).

For this purpose, the discharge vessel with the Xe-excimer discharge advantageously has a phosphor coating for generating a red color spectrum on the inner wall of the discharge vessel. Moreover, for this purpose it is also possible for the second illumination unit to have a discharge vessel with an Xe-excimer discharge, the discharge vessel having a phosphor coating on the inner wall of the vessel in order to generate a green spectrum.

Since the color locus for the blue component of the color mix, when using a discharge vessel with an Xe-excimer discharge and a phosphor coating in the form of a barium magnesium aluminate:Eu, differs only very slightly from the color locus which is achieved with a mercury discharge and the same phosphor coating, it is also conceivable to use a mercury fluorescent lamp as lamp unit here instead of an Xe-excimer fluorescent lamp.

In addition to a combination made up solely of illumination units with Xe-excimer fluorescent lamps and a red, green and blue phosphor coating, mixed component combinations made up of Hg fluorescent lamps and Xe-excimer fluorescent lamps are also suitable for general-purpose illumination. By way of example, Hg fluorescent lamps could be used to achieve high light yields for blue and green, and either only an Xe-excimer fluorescent lamp or an Xe-excimer fluorescent lamp in addition to a red Hg fluorescent lamp could be used to achieve high light yields for red. The lower light yield of the red Xe-excimer fluorescent lamp is then of no importance since its radiation component is required precisely when the other lamps are dimmed.

In this context, it is also conceivable to additionally use a low-pressure discharge lamp without mercury with a pure neon fill. In the case of the neon lamp, the resonance lines of the neon, which are in the red, are excited. This makes it possible to achieve a saturated red without a phosphor having to be used. The neon lamp has a long service life and is dimmable, which is a necessary precondition for power-dependent combination with the other components.

The Xe-excimer lamps may be of any desired form; by way of example, they may be designed as linear radiators with a circular cross section or as flat radiators. The Hg low-pressure discharge lamps may be designed as rod-like lamps with different sizes of circular diameter or as compact lamps with a multiply bent tube with a circular cross section.

The discharge vessels of the components may advantageously have an internal reflector in order to allow directional emission of the radiation.

The discharge vessels of the individual components may be capped on one or two sides.

The discharge vessels of the individual illumination units can be actuated and dimmed by means of electronic ballasts. This ensures that a desired color locus in the chromaticity diagram is set.

The entire illumination device may be designed as a luminaire. Since the radiation generated by the individual components has to be mixed on account of the different color temperatures and/or color loci, so that a person observing the light is given a color impression which is uniform in three dimensions, it is necessary for the radiation to be diffusely scattered at least once in the luminaire. For this purpose, the luminaire advantageously has a reflector and/or a diffusing cover.

However, it is also conceivable for the illumination device to be designed as a compact low-pressure discharge lamp with a central cap at one end, in which case the discharge vessels of the individual illumination units must then take the form of a multiply bent tube, the ends of which are combined and secured in the cap.

BRIEF DESCRIPTION OF THE DRAWINGS

In the text which follows, the invention is described by way of example on the basis of the following exemplary embodiments.

BEST MODE FOR CARRYING OUT THE INVENTION

Figure 1:
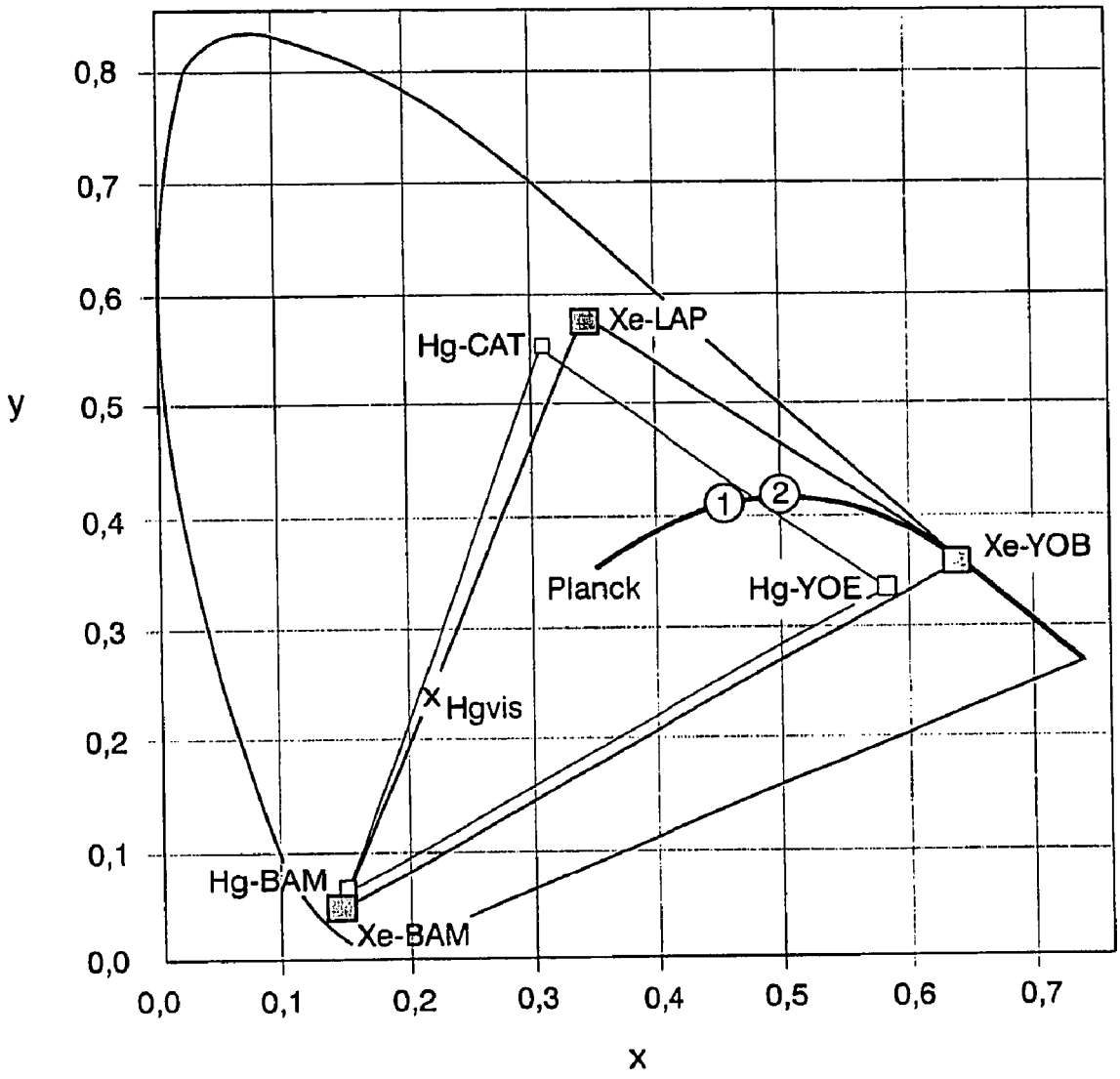
FIG. 1 shows chromaticity diagrams for Xe-excimer lamps and Hg low-pressure discharge lamps having a red, green and blue phosphor coating FIGS. 2*a, b* diagrammatically depict a side view of a first exemplary embodiment of an illumination device in the form of a luminaire, FIG. 3 diagrammatically depicts a second exemplary embodiment of an illumination device in the form of a luminaire FIG. 4 diagrammatically depicts a third exemplary embodiment of an illumination device in the form of a luminaire FIGS. 5*a, b* diagrammatically depict a fourth exemplary embodiment of an illumination device in the form of a luminaire FIG. 6 diagrammatically depicts a fifth exemplary embodiment of an illumination device in the form of a luminaire FIG. 7 diagrammatically depicts a sixth exemplary embodiment of an illumination device in the form of a luminaire FIG. 8 diagrammatically depicts a seventh exemplary embodiment of an illumination device in the form of a luminaire FIG. 9 diagrammatically depicts an eighth exemplary embodiment of an illumination device in the form of a luminaire FIG. 10 diagrammatically depicts a ninth exemplary embodiment of an illumination device in the form of a luminaire FIG. 11 diagrammatically depicts a tenth exemplary embodiment of an illumination device in the form of a luminaire FIG. 12 diagrammatically depicts an eleventh exemplary embodiment of an illumination device in the form of a luminaire FIGS. 13*a, b* diagrammatically depict an exemplary embodiment of an illumination device in the form of a compact lamp FIG. 14 diagrammatically depicts a twelfth exemplary embodiment of an illumination device in the form of a luminaire.
Figure 2B:
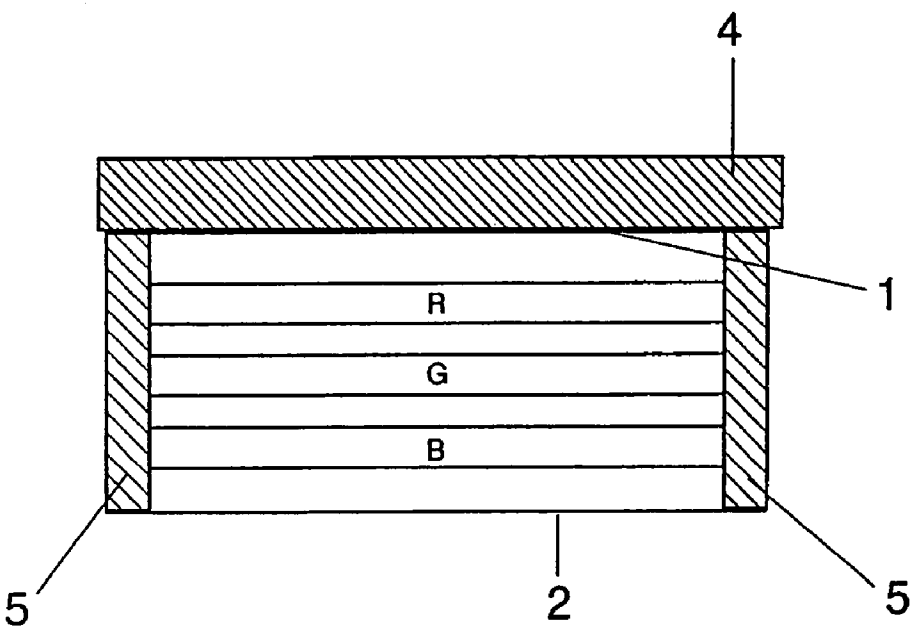
Figure 2A:
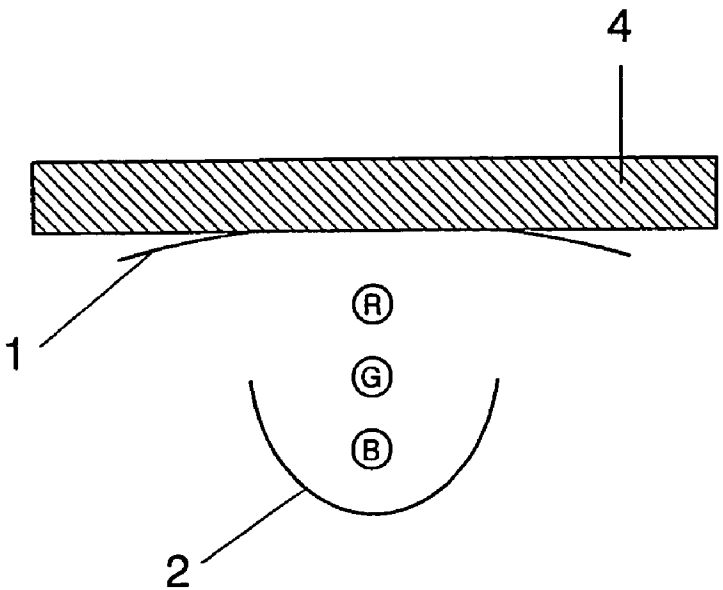

FIGS. 2*a* and 2*b* diagrammatically depict an illumination device in the form of a ceiling luminaire with three illumination units in the form of rod-like discharge vessels which are arranged beneath one another and have an Xe-excimer discharge (Xe-excimer lamp), the top Xe-excimer lamp R, arranged next to the ceiling 4 having a red-emitting phosphor coating, the middle Xe-excimer lamp G having a green-emitting phosphor coating and the bottom Xe-excimer lamp B having a blue-emitting phosphor coating. The caps (not shown) located at in each case the ends of the straight lamps are secured and contact-connected in common mounts 5. The associated ballasts for operating and dimming the Xe-excimer lamps R, G, B are not shown here.

The mixing of the radiation from these three lamps is effected by two curved reflectors, one reflector 1 being arranged above the lamps at the ceiling 2 and one reflector 2 being arranged beneath the lamps in the luminaire.

Figure 3:
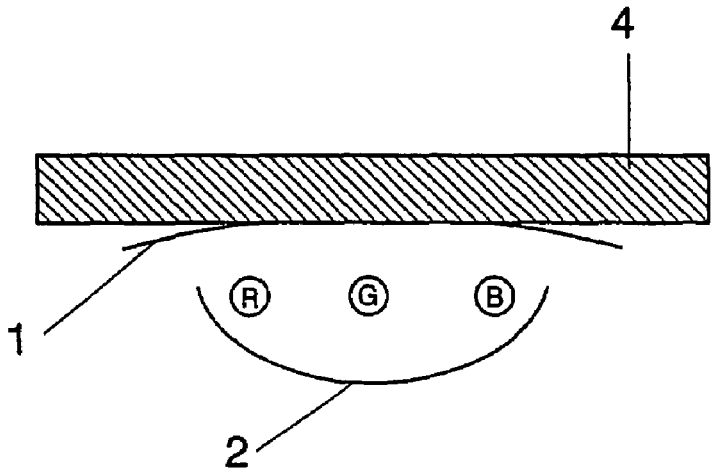

The luminaire shown in FIG. 3 substantially corresponds to the luminaire shown in FIG. 2, except that the Xe-excimer lamps R, G, B are not arranged one beneath the other, but rather next to one another.

Figure 4:
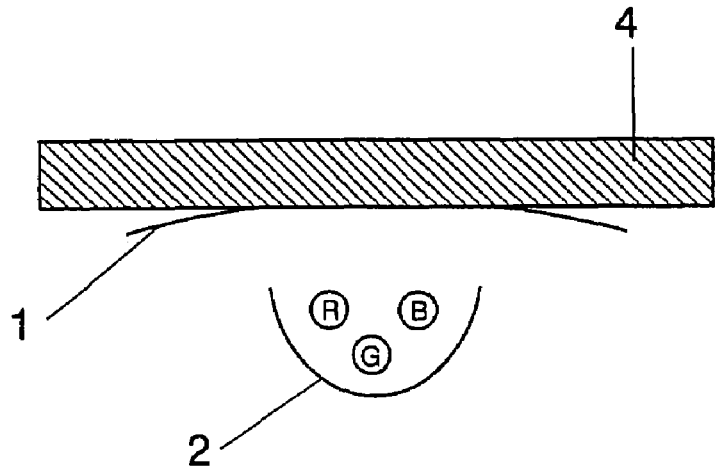

FIG. 4 shows a further embodiment of the luminaire shown in FIG. 2, with the Xe-excimer lamps R, G, B arranged in the form of an equilateral triangle, as seen parallel to the ceiling 4.

Figure 5A:
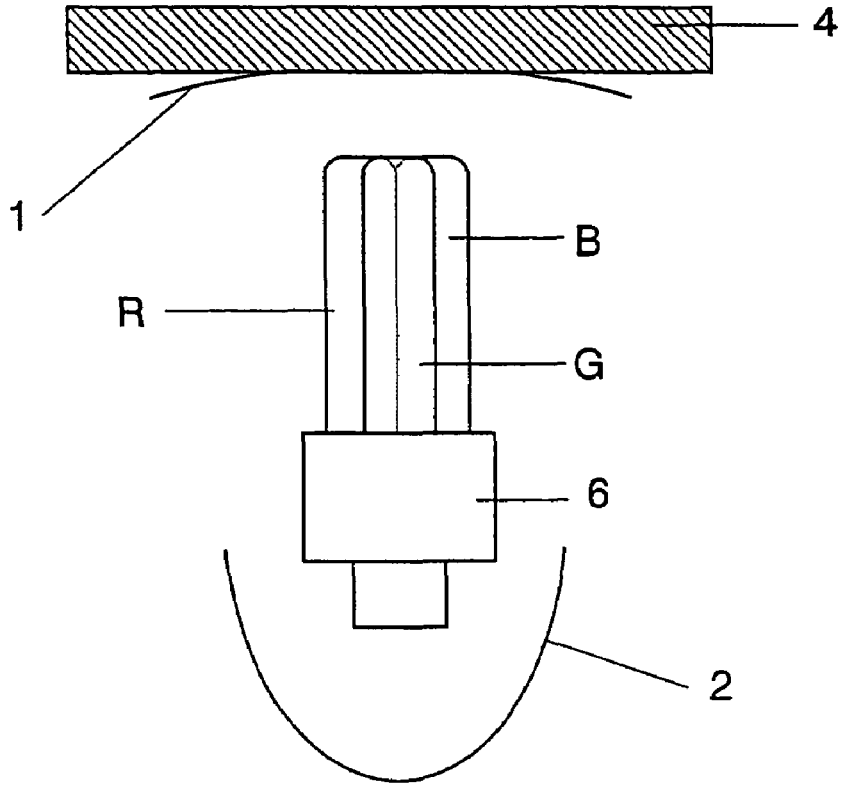
Figure 5B:
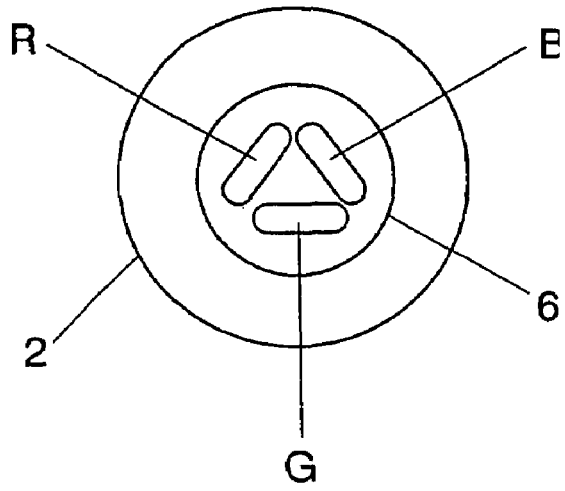

FIGS. 5*a* and *b* illustrate a further illumination device according to the invention in the form of a luminaire. In this case, the luminaire includes three illumination units in the form of discharge vessels R, G, B bent in a U shape, each having an Xe fill, a dielectric barrier discharge and a red or green or blue emitting phosphor coating, the discharge vessels being combined in a common cap-mount system 6. The ballasts for operating and dimming the illumination units are accommodated in the cap-mount system 6. The discharge vessels are arranged rotationally symmetrically about an axis perpendicular to the ceiling 4 within the luminaire. To mix the light, the luminaire has a reflector 1 on the top side and a reflector 2 on the underside of the luminaire.

Figure 6:
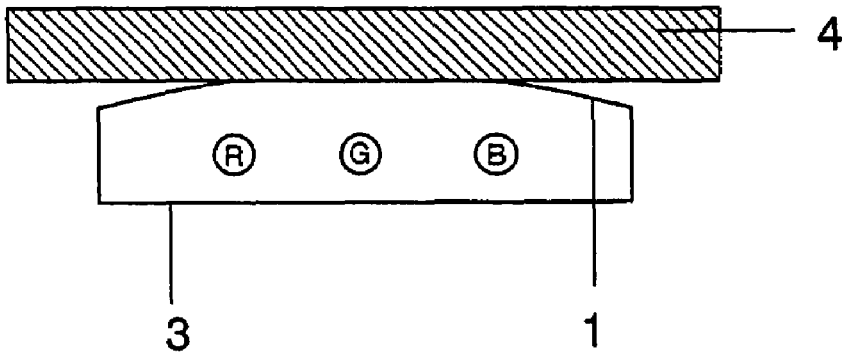

The luminaire illustrated in FIG. 6 substantially corresponds to the luminaire shown in FIG. 3. Instead of the reflector on the underside, however, this luminaire has a scattering disk 3 for diffuse mixing of the radiation emitted by the lamps.

Figure 7:
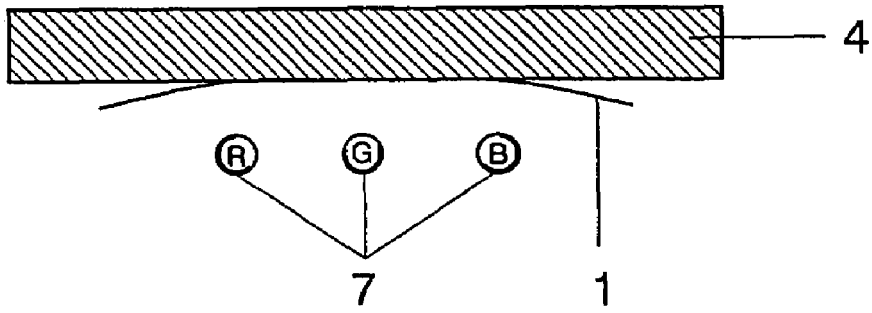

The luminaire shown in FIG. 7 illustrates a further variant of the luminaire illustrated in FIG. 3. Instead of the lower reflector, in this case the Xe-excimer lamps R, G, B are provided with internal reflector coatings 7. The reflector coatings are arranged in such a way that the radiation emitted by the lamps, interacting with the reflector 1 on the top side of the luminaire, undergoes optimum mixing toward the ceiling 4. In addition, as shown in FIG. 8, it is in this case also possible to provide a diffuser 3 at the underside of the luminaire.

Figure 9:
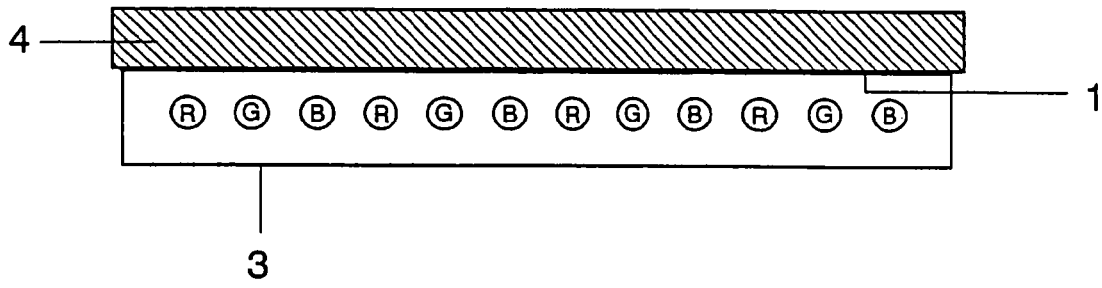

FIG. 9 shows a further variant of the luminaire shown in FIG. 6. Instead of the three Xe-excimer lamps, in this case twelve Xe-excimer lamps, each having a straight tubular discharge vessel and a phosphor coating which alternately emits red R, green G and blue B radiation are arranged parallel to the ceiling 4. The result, therefore, is a flat luminaire which, to mix the radiation, has a reflector 1 at the top side and a diffuser 3 on the underside of the luminaire.

Figure 10:
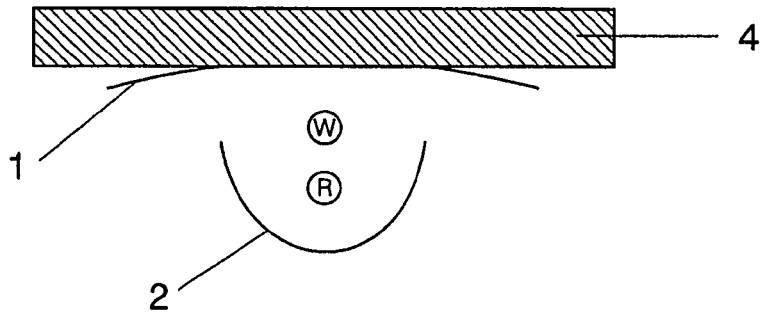

The luminaire illustrated in FIG. 10 substantially corresponds to the luminaire from FIG. 4. In this case, however, instead of the three Xe-excimer lamps just one rod-like Xe-excimer lamp R with a red emitting phosphor coating and one rod-like Hg low-pressure discharge lamp W with a red, green and blue, or white, emitting phosphor coating is integrated in the luminaire.

Figure 8:
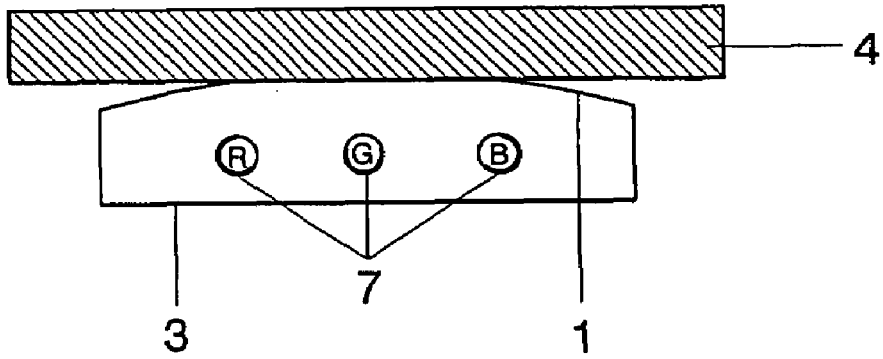
Figure 11:
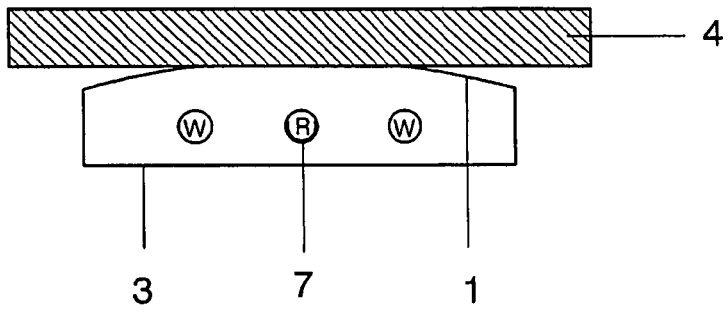

The luminaire illustrated in FIG. 11 is of similar structure to the luminaire shown in FIG. 8. In the middle, it has a rod-like Xe-excimer lamp R with a red emitting phosphor coating and an internal reflector coating 7, and on the left-hand and right-hand sides of this a rod-like Hg low-pressure discharge lamp W without reflector coating and with a white emitting phosphor coating, the discharge vessels in each case running parallel to one another and parallel to the ceiling 4.

Figure 12:
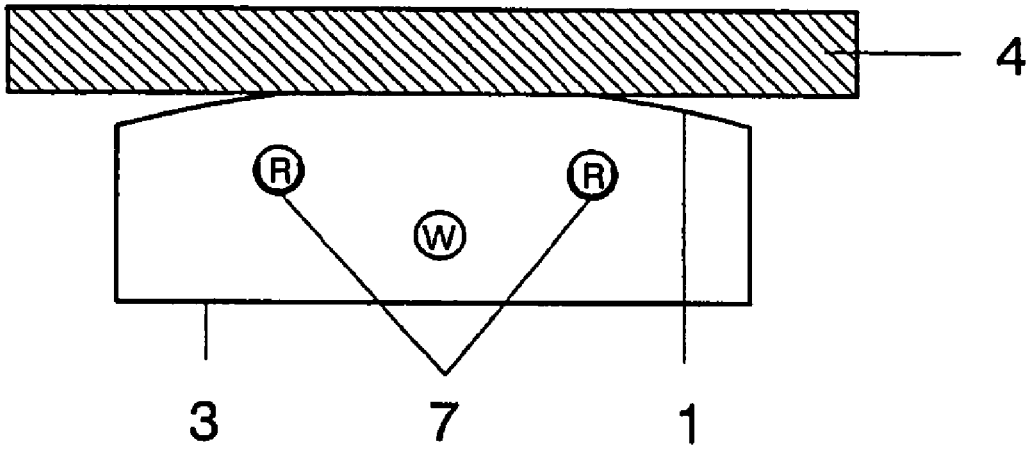

The luminaire shown in FIG. 12 is of similar structure to that shown in FIG. 11, but in this case a rod-like Hg low-pressure discharge lamp W with a white emitting phosphor coating is arranged in the middle and an offset rod-like Xe-excimer lamp R with a red emitting phosphor coating and an internal reflector coating 7 is arranged on the left-hand and right-hand sides of this.

Instead of the Hg low-pressure discharge lamps with a white emitting phosphor coating, it is also possible to use Xe-excimer lamps with a red, green and blue, or white, emitting phosphor coating in the luminaires.

Figure 14:
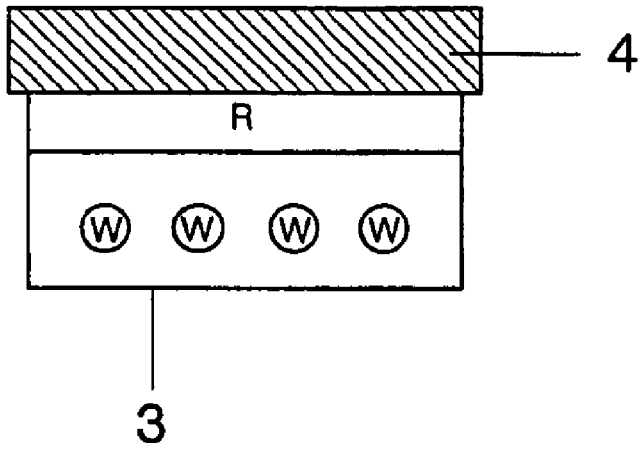

FIG. 14 shows a flat luminaire, in which, with respect to the ceiling 4, first of all one flat Xe-excimer lamp R with a red emitting phosphor coating and then four rod-like Hg low-pressure discharge lamps W with a white emitting phosphor coating are integrated in the luminaire. Moreover, at the top side the luminaire has a reflector 1 and at the underside it has a diffuser 3.

Figure 13A:
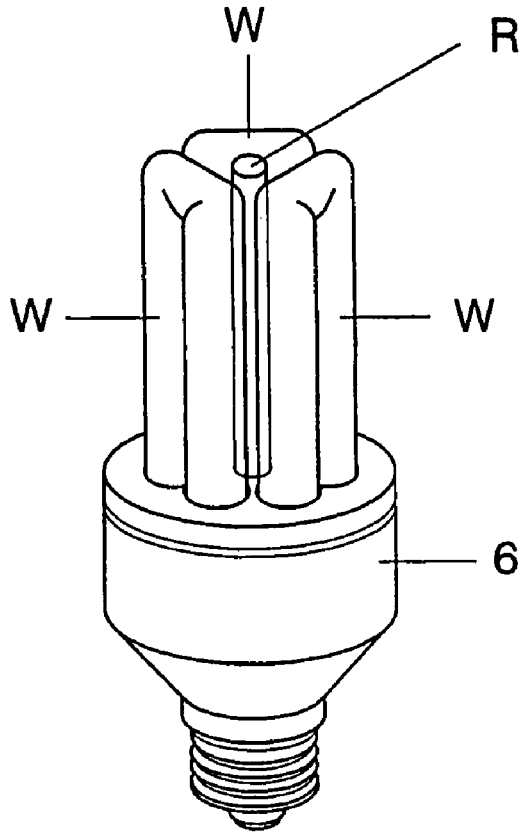
Figure 13B:
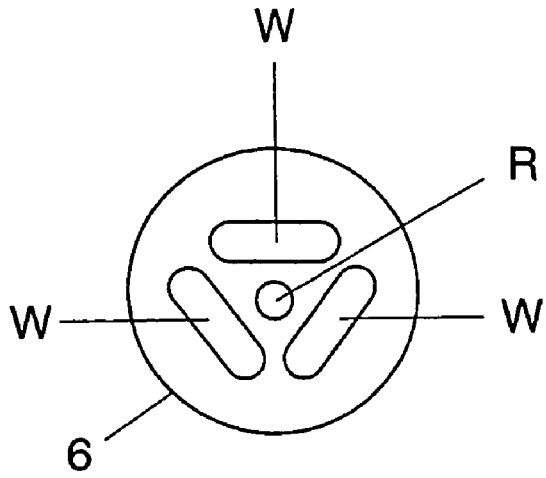

FIGS. 13*a* and *b* illustrate an illumination device according to the invention in the form of a compact low-pressure discharge lamp. The lamp includes three illumination units in the form of discharge vessels W which are bent in a U shape, are in an equilateral triangle arrangement and each have an Hg low-pressure discharge and a white emitting phosphor coating, the discharge vessels being combined in a common cap 6. In the center of the discharge vessels which have been bent in a U shape, a further illumination unit in the form of a tubular Xe-excimer lamp R with a red emitting phosphor coating is arranged parallel to the axes of the longitudinal tubes of the discharge vessels that have been bent in a U shape. The ballasts for operating and dimming the illumination units are accommodated in the cap 6. At the end remote from the discharge vessels, the cap 6 has a screw thread of the E27 type.

What is claimed is:

1. An electrical illumination device, comprising at least one mercury low-pressure discharge lamp that emits a white light when operating, a xenon-excimer dielectric barrier discharge lamp that emits a red light when operating, the at least one mercury low-pressure discharge lamp and the xenon-excimer dielectric barrier discharge lamp being mounted to the same side of a common cap wherein the xenon-excimer dielectric barrier discharge lamp is located in the center of the cap.

2. The electrical illumination device as claimed in claim 1, wherein the electrical illumination device is a luminaire.

3. The electrical illumination device as claimed in claimed 2, wherein the luminaire has a reflector.

4. The electrical illumination device as claimed in claim 2, wherein the luminaire has a cover in the form of a diffuser.

5. The electrical illumination device as claimed in claim 1, wherein the electrical illumination device is a compact low-pressure discharge lamp.

6. The electrical illumination device as claimed in claim 1, wherein the electrical illumination device has three tubular mercury low-pressure discharge lamps that are bent in a U-shape having longitudinal tubes, and the xenon-excimer dielectric barrier discharge lamp has a tubular shape and is affanged parallel to the axes of the longitudinal tubes of the mercury low-pressure discharge lamps.

7. The electrical illumination device as claimed in claim 6 wherein the xenon-excimer dielectric discharge lamp contains a yttrium gadolinium borate:Eu phosphor.

8. The electrical illumination device as claimed in claim 1 wherein the xenon-excimer dielectric discharge lamp contains a yttrium gadolinium borate:Eu phosphor.

9. The electrical illumination device as claimed in claim 1 wherein electronic ballasts for operating and dimming the lamps are accommodated in the cap.

* * * * *